US007866078B1

(12) United States Patent
Beretta

(10) Patent No.: US 7,866,078 B1
(45) Date of Patent: Jan. 11, 2011

(54) MECHANISM FOR LOCKING AND ADJUSTING THE ASSEMBLY TENSION OF THE STOCK TO A RECEIVER OF A FIREARM

(75) Inventor: Ugo Gussalli Beretta, Gardone Val Trompia (IT)

(73) Assignee: Fabbrica D'Armi Pietro Beretta S.p.A., Gardone Val Trompia (Brescia) (IT)

( * ) Notice: Subject to any disclaimer, the term of this patent is extended or adjusted under 35 U.S.C. 154(b) by 475 days.

(21) Appl. No.: 11/906,684

(22) Filed: Oct. 3, 2007

(30) Foreign Application Priority Data

Oct. 17, 2006 (IT) ..... MI2006A1994

(51) Int. Cl.
*F41A 11/00* (2006.01)

(52) U.S. Cl. ..... 42/75.03

(58) Field of Classification Search ..... 42/75.01, 42/75.03

See application file for complete search history.

(56) References Cited

U.S. PATENT DOCUMENTS 2,610,426 A * 9/1952 Emerson ..... 42/75.01
2,790,262 A 4/1957 Baker
2,933,983 A * 4/1960 Ruger ..... 89/194
5,813,158 A 9/1998 Campbell
2003/0029070 A1* 2/2003 Dowding ..... 42/75.03
2007/0089347 A1* 4/2007 Webber et al. ..... 42/75.03

FOREIGN PATENT DOCUMENTS

GB 24995 2/1900
WO WO2006/101410 9/2006

OTHER PUBLICATIONS

European Search Report Dated Jan. 25, 2008.

* cited by examiner

*Primary Examiner*—Stephen M Johnson
(74) *Attorney, Agent, or Firm*—Hedman & Costigan, P.C.; James V. Costigan

(57) ABSTRACT

A mechanism (40) for locking and adjusting the assembly tension of the stock (20) to a receiver (12) of a firearm (10), characterized in that it comprises locking and tensioning means (50) integrally connected in an swinging manner to the stock (20) and in turn provided with a contact profile (51) adapted to be commanded in rotation around a hinging pin (41) and an engagement portion (54) adapted to cooperate with a stock bolt (16) integral with the receiver (12), in order to make said locking and tensioning means (50) pass, following the rotation of the contact profile, from an unlocked position of the stock bolt (16) to an engagement position of said stock bolt with increasing tension, and vice versa.

11 Claims, 4 Drawing Sheets

MECHANISM FOR LOCKING AND ADJUSTING THE ASSEMBLY TENSION OF THE STOCK TO A RECEIVER OF A FIREARM

The present invention refers to a mechanism for locking and adjusting the assembly tension of the stock to a receiver of a firearm.

In particular, the invention concerns a mechanism intended for a long firearm such as a long field or competition gun, over-and-under or side-by-side, generally but not exclusively break-open.

It is known that in the long firearms, the stock made of wood or polymer is assembled to the frame and in particular to the receiver.

Such assembly is subjected to considerable recoiling forces during the shooting; such phenomenon, characteristic of the action-reaction principle, indicates the impulse that makes the firearm go backward, due to the impulse that the firearm imparts to the projectile when launching it.

The aforesaid impulse forces are discharged in the abutment zone of the stock of the long gun, the shooter's shoulder, and considering that the maximum peak of acceleration can impart forces on the order of 300-400 kg, it is understood how the firearm according to a first aspect must be conveniently equipped with devices adapted to reduce the effect of such forces on the shooter and, according to another aspect, how the assembly must be made with particular care so to ensure over time repetitiveness of the induced stresses in the shooting stage.

Moreover, in the last few years the need to adapt the firearm, produced with necessarily standardised sizes, to the grip and ergonomic characteristics of the individual has led to the insertion of shim and cast devices which allow "personalising" the firearm and in particular the stock according to shooter needs.

According to the devices employed, there can therefore be misalignments which involve further stresses for the stock-receiver assembly to bear.

According to the prior art, the fixing of the stock to the frame is carried out by means of a centring stock bolt, appropriately equipped with threads at the ends, fixed to the receiver and on which the stock is engaged, equipped with longitudinal through cavity.

The stock is then tightened by means of a nut to be inserted in the longitudinal cavity under the butt-plate. The operation is completed with the mounting of the butt-plate.

According to other prior art, a stock bolt is provided for which is directly screwed into the frame with appropriate keys, without having to disassemble the butt-plate.

In any case, such dismantling systems, affecting the entire length of the stock, interfere with many of the devices which must be positioned inside the stock itself.

Moreover, such systems, while permitting a good initial tensioning of the assembly, for the subsequent adjustments of the assembly (which with the use of the gun tends to loosen—following the wear of the components and the contact surfaces) they generally require complex operations on the possible anti-recoil system present and thus on the adjustment of the butt-plate itself.

The applicant has therefore addressed the problem of how to achieve a tightening of the stock to the frame that is effective and adjustable such to recover possible assembly clearances, that does not interfere with possible devices present in the stock and is light and easy to make and operate.

The applicant has been able to resolve the aforesaid problems by providing a mechanism for locking and adjusting the assembly tension of the stock to a receiver of a firearm.

The main object of the present invention is to make an alternative locking and adjusting mechanism to the known mechanisms, which does not require the dismantling of the butt-plate and does not interfere with possible devices positioned in the terminal portion of the stock. Another object of the present invention is to make a mechanism for locking and adjusting the assembly tension of the stock to a receiver of a firearm which allows an improved adjustment of the assembly tension between stock and frame.

These and other objects according to the present invention are reached by means of a mechanism for locking and adjusting the assembly tension of the stock to a receiver of a firearm, according to that set forth in claim 1.

Further characteristics are provided for in the dependent claims.

The mechanism for locking and adjusting the assembly tension of the stock to a receiver of a firearm according to the invention comprises locking and tensioning means which are integrally connected in an swinging manner to the stock and in turn provided with a contact profile adapted to be commanded in rotation around a hinging pin and an engagement portion adapted to cooperate with a stock bolt integral with the receiver, in order to pass—following the rotation of the contact profile—from an unlocked position of the stock bolt to an engagement position of said stock bolt with increasing tension and vice versa.

The characteristics and advantages of a mechanism for locking and adjusting the assembly tension of the stock to a receiver of a firearm according to the present invention will be more evident from the following exemplifying and non-limiting description, referred to the attached schematic drawings in which.

Figure 1:
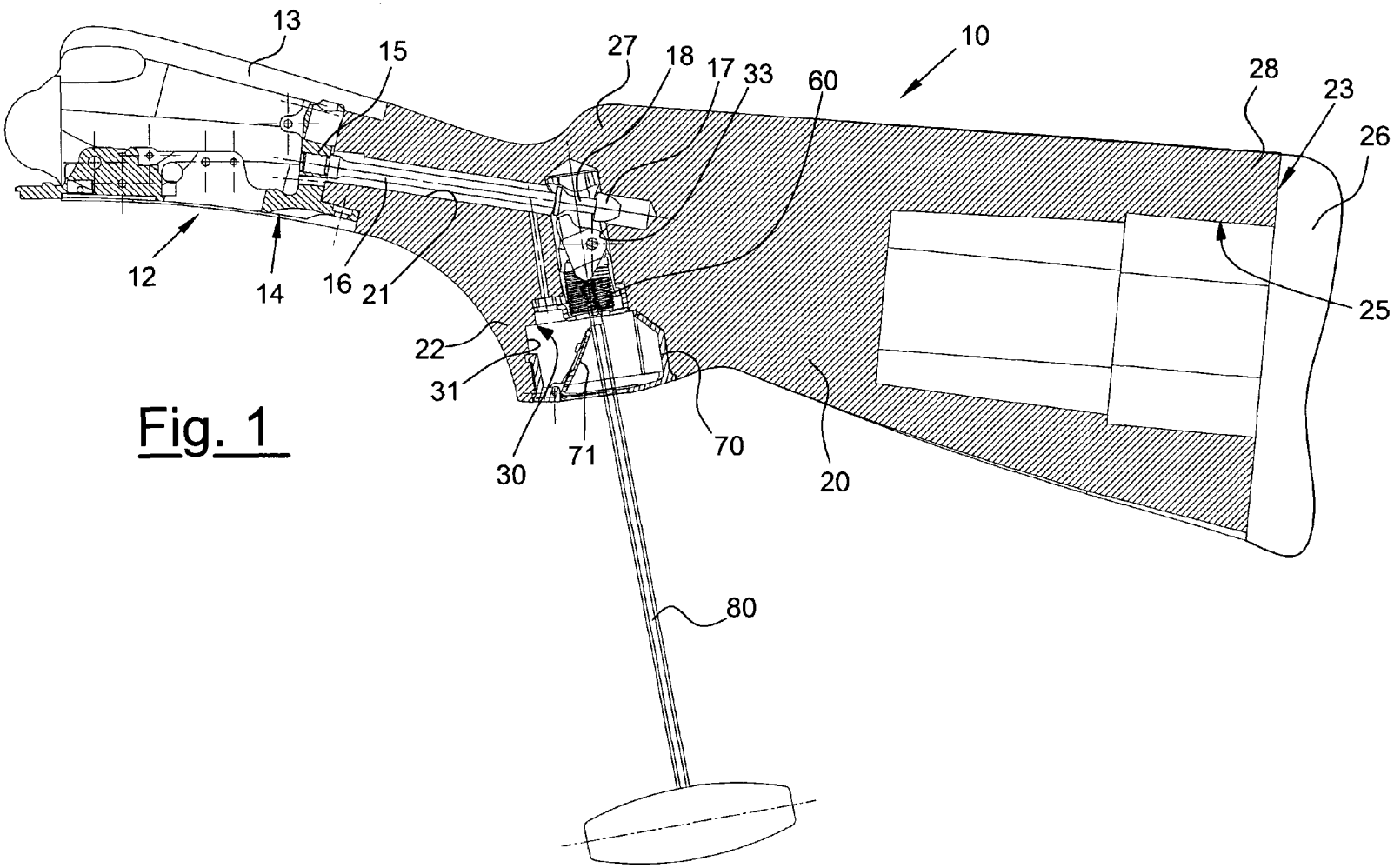
FIG. 1 is a side elevation view, partially in section, of a central part of a long firearm bearing the mechanism according to the invention and with the stock mounted on the frame in unlocked position.
Figure 2:
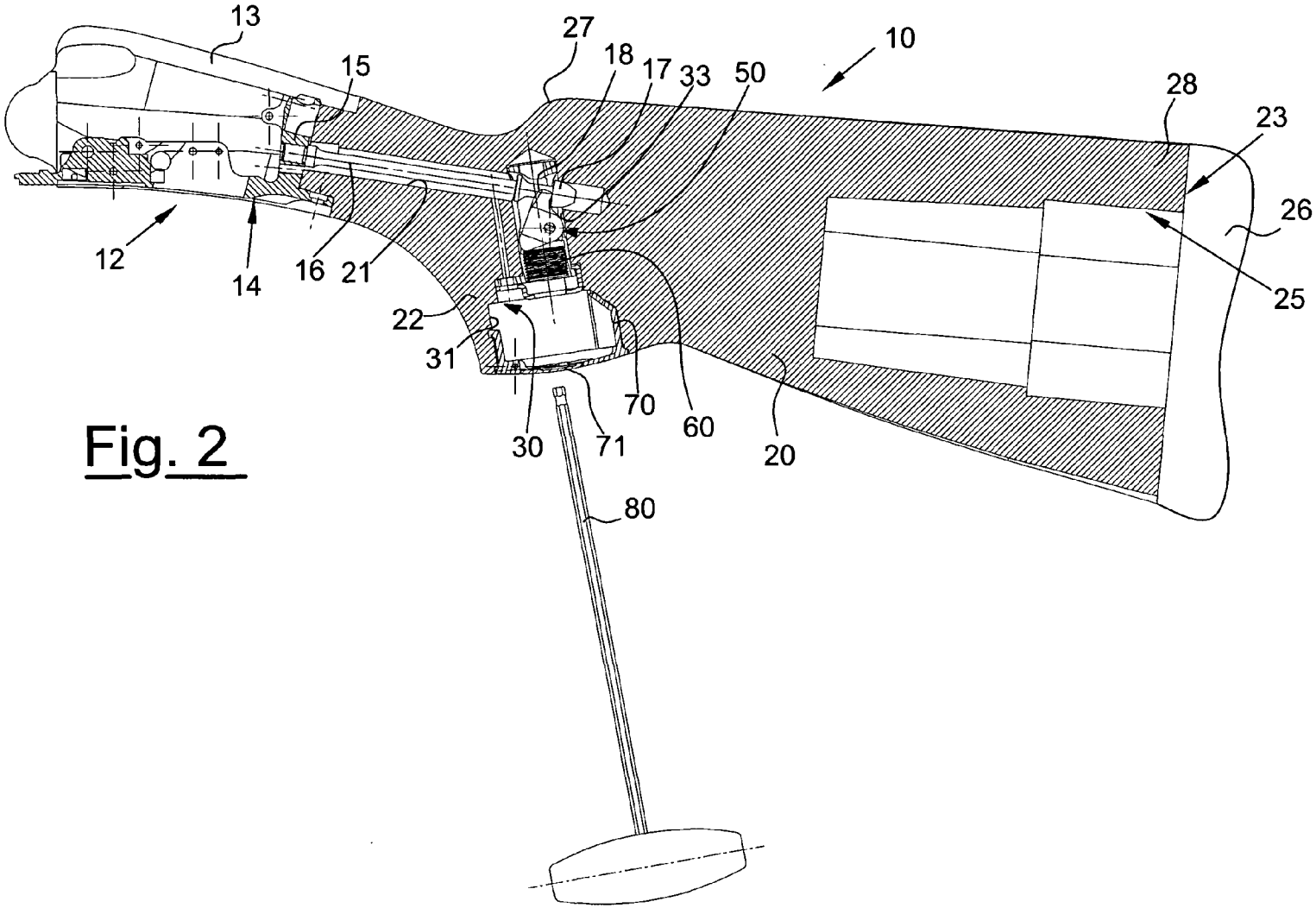
FIG. 2 is a side elevation view, partially in section, of a central part of a long firearm bearing the mechanism according to the invention and with the stock mounted on the frame in locked position.
Figure 3:
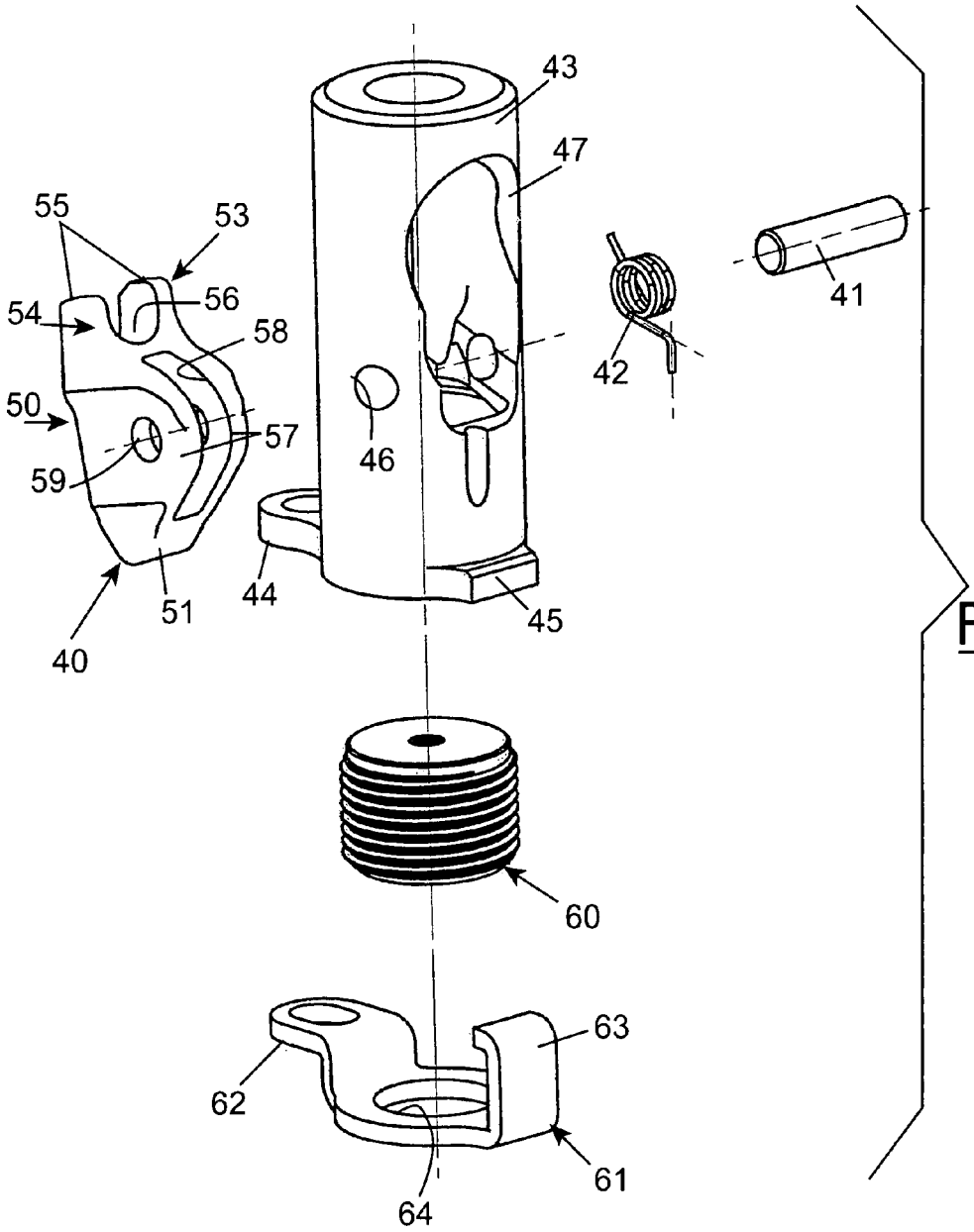
FIG. 3 is an exploded perspective view of the mechanism according to the invention.
Figure 4:
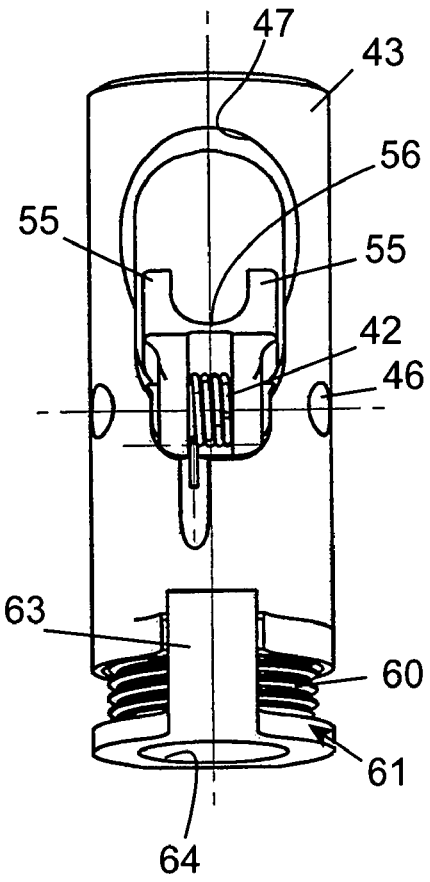
FIG. 4 is a front elevation view of the mechanism according to the invention.
Figure 5:
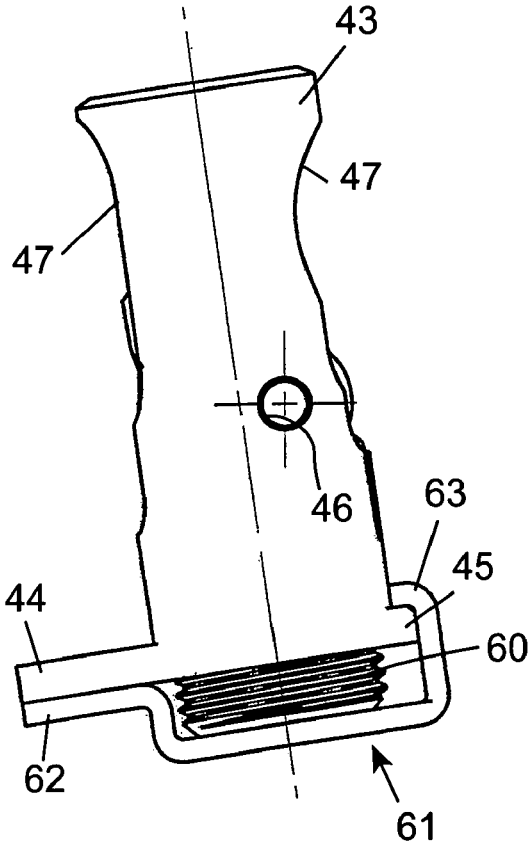
FIG. 5 is a side elevation view of the mechanism according to the invention in a possible position which it would occupy inside the stock of the firearm.

With reference to the figures, a firearm 10 has a stock 20 and a frame 12 in the matter at hand comprising an action body 13 and a trigger plate 14 equipped with breech face 15 intended for fixing the trigger plate 14 to the action body 13.

A shaped stock bolt 16 is fixed to the receiver surface 15 by means of screwing, such stock bolt 16 extending from the frame in order to receive the firearm stock 20. For such purpose, the stock has a channel 21 substantially parallel to its longitudinal axis and being extended in the direction of the terminal portion 23 of the stock substantially up to the zone of the pistol grip 22 or a little beyond.

The stock can moreover have a suitable seat 25 in the terminal portion facing the butt-plate 26 in order to receive shock-absorbing recoil devices and/or stock length adjusters. Further seats (not illustrated) can moreover be arranged between the comb 27 and the heel 28 for the insertion of drop adjustment devices.

The mechanism 40 for locking and adjusting the assembly tension of the stock 20 to the receiver 12 according to the invention is housed within a shaped seat 30 made in the pistol grip 22 of the stock, with a chamber 31 which leads to the base of the pistol grip 22 and is connected at its upper part to a cylindrical slot 33 inside the stock and intersecting the channel 21.

The mechanism 40 for locking and adjusting the assembly tension of the stock 20 to the receiver 12 of a firearm 10 comprises locking and tensioning means made in the form of a stirrup 50, integrally connected in a swinging manner to the stock.

The stirrup 50 in turn is provided with a contact profile 51 adapted to be commanded in rotation around a hinging pin 41 and an engagement portion 53 adapted to cooperate with the stock bolt 16 integral with the receiver 12, in order to pass, following the rotation of the contact profile 51, from an unlocked position of the stock bolt 16 to an engagement position of said stock bolt 16 with increasing tension, or vice versa from an engagement position under tension to an unlocked position.

The engagement portion 53 is made in the form of a fork 54 with a pair of tips 55 adapted to retain a head 17 made in the terminal portion of the stock bolt, surmounting a neck 18 of lower diameter prearranged for receiving the groove 56 between the two tips 55.

The stirrup 50 centrally has an extended portion formed by two parallel arches 57 which are separated by a slot 58, arches 57 which connect to the contact profile 51 and which are crossed by a pair of holes 59 for the insertion of the hinging pin 41.

Within the slot 58, a coil spring 42 is housed, wound on the pin 41 and adapted to bring the stirrup back to the unlocked position.

The rotation of the stirrup is commanded by means of a screw 60, thrust driving the contact profile 51, with force application point which always results misaligned with respect to the pin 41 rotation axis.

In such a manner, by screwing the screw 60, it is possible to carry out a continuous tightening for the recovery of possible clearances between stock and receiver, while by unscrewing the screw 60, the spring 42 brings the stirrup back to the unlocked position.

The mechanism 40 is housed within a bush 43 to be inserted inside the cylindrical slot 33 made in the area inside the stock of the shaped seat 30.

Such bush 43 comprises a hollow cylindrical body equipped with side openings 47 for the passage of the stock bolt 16, and equipped at the base with a tooth 45 and an eyelet 44 adapted to receive in engagement a check bottom plate 61 adapted to retain the screw 60, preventing its disengagement from the bush.

In particular, the tooth 45 is coupled by a hook 63 provided on the bottom plate 61 while a perforated plate 62 is provided to correspond with the eyelet 44 for the passage of a fixing screw of the bottom plate-bush set bearing the mechanism 40 to the stock of the long gun. The bottom plate 61 has an opening 64 for the passage of an appropriate key 80 adapted to engage the screw 60 for adjusting the tightening tension or for unlocking of the stock.

The chamber 31 is closed by means of a plug 70 which partially matches its walls and which is equipped with a spring door 71 which closes the bottom plate of the pistol grip 22 and can be directly actuated with the key 80.

The mechanism according to the invention can be mounted on a preferably long firearm, like a long gun or carbine, or a short gun but nonetheless equipped with stock intended for shoulder support.

Among the long guns, it can be mounted on weapons with break-open barrel(s), i.e. in which the opening of the firearm is achieved by the rotation of the barrel (or barrels) with respect to the breech face, or action body, or on semi-automatic weapons with fixed barrel, without limitations with regard to the type of weapon which can be of sport type (for example an over-and-under or side-by-side or single-barrel long gun), with smooth or rifled barrel.

The mechanism for locking and adjusting the assembly tension of the stock to a receiver of a firearm, object of the present invention, has the double object of achieving the locking of the tension assembly with progressively adjustable tension in order to recover the tightening loss due to the coupling wear, and to not interfere with the terminal portion of the weapon stock.

The invention claimed is:

1. An adjustable locking device for locking and adjusting the assembly tension between a stock (20) and a frame (12) of a firearm (10), characterised in that said adjustable locking device comprises a stirrup (50) connected by a hinging pin (41) to the stock (20) where said stirrup (50) is provided with a contact profile (51) and said stirrup (50) is adapted to be commanded in rotation around a said hinging pin (41), said stirrup having an engagement portion (53) in the form of a fork (54) adapted to cooperate with a stock bolt (16) connected to the receiver (12), said contact profile (51) being adapted to receive a thrust from a screw (60) that causes said stirrup (50) to rotate around hinging pin (41), from an unlocked position of the stirrup (50) to an engagement position of said stirrup (50) on the stock bolt (16) wherein the tension between the stirrup (50) and the stock bolt (16) is increased by the rotation of the stirrup, and when the thrust from screw (60) is reversed, to rotate from the engagement position where said stirrup (50) is in tension with said stock bolt (16) to the unlocked position.

2. An adjustable locking device according to claim 1, wherein said stirrup (50) in which the engagement portion (53) is made in the form of a fork (54) said fork (54) having a pair of tips (55) adapted to retain a head (17) located at the terminal portion of the stock bolt (16), wherein said terminal portion of stock bolt (16) has adjacent to said terminal portion a neck (18) of lower diameter prearranged for receiving a groove (56) located between said pair of tips (55).

3. An adjustable locking device according to claim 2, wherein said stirrup (50) is centrally equipped with an extended portion formed by two parallel arches (57), separated by a slot (58), said arches (57) being connected to the contact profile (51) and being crossed by a pair of holes (59) for the insertion of the hinging pin (41).

4. An adjustable locking device according to claim 3, wherein the slot (58) is adapted for housing a coil spring (42) wound on the pin (41) and adapted to bring the stirrup back to the unlocked position.

5. An adjustable locking device according to claim 4, wherein the screw (60) which is provided for thrust driving the contact profile (51) for the rotation of the stirrup (50), has a force application point on the stirrup (50) which is misaligned with respect to the rotation axis of the pin (41).

6. An adjustable locking device according to claim 5, wherein the stirrup (50) is housed within a bush (43) to be inserted within a cylindrical slot (33) made in the stock (20).

7. An adjustable locking device according to claim 6, wherein said stock (20) has a shaped seat (30) made in a pistol grip (22) on said stock (20) and comprises a chamber (31) which leads to a base of the pistol grip (22) where said pistol grip (22) is connected on an upper part to said cylindrical slot (33) inside the stock.

8. An adjustable locking device according to claim 7, wherein said bush (43) comprises a hollow cylindrical body equipped with side openings (47) for the passage of the stock bolt (16), and equipped at the base with a tooth (45) and an eyelet (44) adapted to receive a check bottom plate (61) adapted to retain the screw (60), preventing said screw (60) from disengagement from the bush.

9. An adjustable locking device according to claim 8, wherein said tooth (45) is provided which can be coupled by a hook (63) provided on the bottom plate (61) while a perforated plate (62) is provided for to correspond with the eyelet (44) for the passage of a fixing screw of the bottom plate of the bush that bears the stirrup (50) on the stock of a long gun.

10. An adjustable locking device according to claim 9, wherein said bottom plate (61) has an opening (64) for the passage of a suitable key (80) adapted to engage the screw (60) for adjusting the tightening tension or for unlocking the stock.

11. An adjustable locking device according to claim 10, wherein a plug (70) is provided for closing said chamber (31), said plug (70) being equipped with a spring door (71) which closes the bottom of the pistol grip (22) and when said spring door is open the screw (60) is directly drivable with said key (80).

* * * * *